US006685107B1

(12) United States Patent
Salzman

(10) Patent No.: US 6,685,107 B1
(45) Date of Patent: Feb. 3, 2004

(54) SOAP DISPENSING SPRAY NOZZLE

(76) Inventor: Allan J. Salzman, 56 Williams Rd., Sharon, MA (US) 02067

( * ) Notice: Subject to any disclaimer, the term of this patent is extended or adjusted under 35 U.S.C. 154(b) by 0 days.

(21) Appl. No.: 09/950,934

(22) Filed: Sep. 12, 2001

(51) Int. Cl.[7] ..... A62C 5/02; A62C 11/00; B05B 7/26; B05B 9/043; B05B 7/12

(52) U.S. Cl. ..... 239/310; 239/333; 239/413; 239/526; 222/383.1

(58) Field of Search ..... 239/406, 407, 239/408, 409, 413, 418, 422, 443, 444, 526, 310, 525, 333; 222/372, 382, 383.1, 383.3, 129, 133, 144.5

(56) References Cited

U.S. PATENT DOCUMENTS

| | | | | | |
|---|---|---|---|---|---|
| 2,639,945 | A | * | 5/1953 | Rowlett | 137/565.34 |
| 3,361,300 | A | * | 1/1968 | Kaplan | 222/133 |
| 3,675,851 | A | | 7/1972 | Merfeld et al. | |
| 4,135,882 | A | | 1/1979 | Harkness et al. | |
| 4,275,836 | A | | 6/1981 | Egger | |
| 4,795,096 | A | | 1/1989 | Smith | |
| 4,854,505 | A | | 8/1989 | LaVine, Jr. | |
| 4,956,883 | A | * | 9/1990 | Lane | 4/605 |
| 5,238,191 | A | * | 8/1993 | Gaymon | 239/526 |
| 5,341,836 | A | | 8/1994 | Doherty | |
| 5,590,719 | A | | 1/1997 | McLoughlin et al. | |
| 5,649,334 | A | * | 7/1997 | Henriquez et al. | 15/29 |
| 5,778,459 | A | | 7/1998 | Guerin | |
| 6,000,626 | A | * | 12/1999 | Futo et al. | 239/74 |
| 6,378,789 | B1 | * | 4/2002 | Seaman et al. | 239/443 |
| 2002/0190139 | A1 | * | 12/2002 | Morrison | 239/315 |

* cited by examiner

*Primary Examiner*—Michael Mar
*Assistant Examiner*—Darren Gorman
(74) *Attorney, Agent, or Firm*—Bromberg & Sunstein LLP

(57) ABSTRACT

A soap dispensing spray nozzle includes a mechanism for injecting liquid soap into a water stream outside of the soap dispensing spray nozzle as the water stream leaves the soap dispensing spray nozzle. The liquid soap can be selectively injected into the water stream, so that the soap dispensing spray nozzle can produce either a clear water stream when no soap is injected into the water stream or a soapy foam when soap is injected into the water stream.

5 Claims, 2 Drawing Sheets

SOAP DISPENSING SPRAY NOZZLE

FIELD OF THE INVENTION

The present invention relates generally to spray nozzles, and more particularly to a soap dispensing spray nozzle.

BACKGROUND

A spray nozzle that produces a soapy foam is useful for many things. In such a spray nozzle, liquid soap is typically mixed with water prior to or within the spray nozzle, and the soap/water mixture is ejected from the spray nozzle under pressure to produce the soapy foam.

One problem with such a spray nozzle is that it is difficult to stop the production of the soapy foam. Even when no more liquid soap is mixed with the water, a residual soap/water mixture can continue to produce the soapy foam for an extended period of time.

SUMMARY OF THE INVENTION

In accordance with one aspect of the invention, a soap dispensing spray nozzle includes a mechanism for injecting liquid soap into a water stream outside of the soap dispensing spray nozzle as the water stream leaves the soap dispensing spray nozzle. The liquid soap can be selectively injected into the water stream, so that the soap dispensing spray nozzle can produce either a clear water stream when no soap is injected into the water stream or a soapy foam when soap is injected into the water stream.

In a typical embodiment of the present invention, the soap dispensing spray nozzle includes a pump-action spray trigger for controlling the flow of liquid soap into the water stream.

DETAILED DESCRIPTION OF A PREFERRED EMBODIMENT

Figure 1:
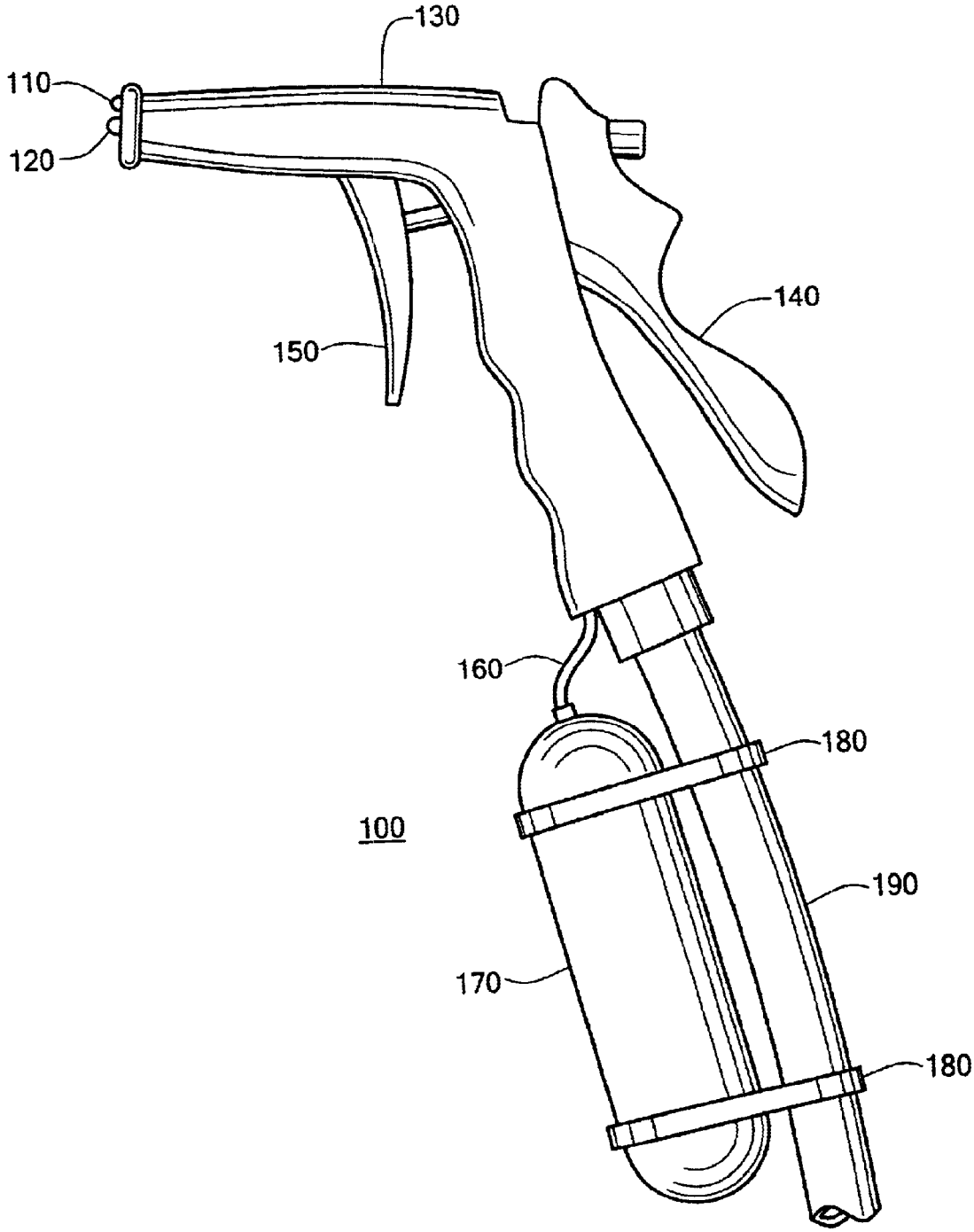
FIG. 1 shows an exemplary soap dispensing spray nozzle in accordance with an embodiment of the present invention.

In an embodiment of the present invention, a soap dispensing spray nozzle includes a mechanism for injecting liquid soap into a water stream in order to produce a soapy foam. The liquid soap is injected into the water stream outside of the soap dispensing spray nozzle as the water stream leaves the soap dispensing spray nozzle. In this way, there is no mixing of soap and water prior to or within the soap dispensing spray nozzle. The liquid soap can be selectively injected into the water stream, so that the soap dispensing spray nozzle can produce either a clear water stream when no soap is injected into the water stream or a soapy foam when soap is injected into the water stream.

In a typical embodiment of the present invention, the soap dispensing spray nozzle includes at least one soap dispensing orifice somewhere near the water outlet. The soap dispensing orifice(s) are typically aimed toward the water stream so that the liquid soap is injected into the water stream. The present invention is in no way limited to any particular type, placement, or configuration of soap dispensing orifice(s).

The liquid soap is typically drawn into the soap dispensing spray nozzle from a soap container. The soap container can be integral to the soap dispensing spray nozzle or attached directly or indirectly to the soap dispensing spray nozzle. The present invention is in no way limited to any particular type or placement of soap container.

The liquid soap is typically drawn from the soap container and injected into the water stream under pressure. Thus, the soap dispensing spray nozzle typically includes a mechanism for drawing the liquid soap from the soap container. The mechanism can be activated in a variety of ways, including, but in no way limited to, manually, using water pressure, using water flow, using air pressure, and using gravity, to name but a few. In a typical embodiment of the present invention, the soap dispensing spray nozzle includes a pump-action spray trigger that, when depressed, causes a squirt of liquid soap to be drawn from the soap container and injected into the water stream. In various alternative embodiments, water pressure can be used, for example, to compress the soap container or depress a plunger or piston into the soap container in order to force the soap from the soap container; water flow can be used, for example, to turn a pump (e.g., via a turbine or water wheel) in order to force the soap from the soap container; water flow can be used, for example, to draw the liquid soap from the soap container via a venturi effect; air pressure can be used, for example, to pressurize the soap container in order to force the liquid soap from the soap container; and gravity can be used, for example, by placing the soap container higher than the soap dispensing orifice(s) so that the liquid soap can flow into the soap dispensing spray nozzle. The present invention is in no way limited to any particular mechanism for drawing the liquid soap from the soap container.

The soap dispensing spray nozzle typically includes a mechanism for controlling the flow of liquid soap, and specifically for starting and stopping the flow of liquid soap. In a typical embodiment of the present invention, in which a pump-action spray trigger is used to inject the liquid soap into the water stream, the pump-action spray trigger controls the flow of liquid soap into the water stream such that liquid soap is only injected into the water stream when the pump-action spray trigger is depressed. Alternatively, any of a variety of on/off valves can be used to control the flow of liquid soap.

The present invention is in no way limited to any particular mechanism for controlling the flow of liquid soap.

FIG. 1 shows an exemplary embodiment of a soap dispensing spray nozzle 100. The soap dispensing spray nozzle 100 includes a body 130 that is coupled to garden hose 190. The body 130 houses a water valve that is actuated by water flow trigger 140 for controlling the flow of water through the water outlet 120 as well as a pump-action spray valve that is actuated by soap flow trigger 150 for controlling the flow of liquid soap through soap dispensing orifice 110. A soap container 170 holds liquid soap. The soap container 170 is attached to the hose 190 via clips 180. Liquid soap is drawn into the body 130, and more specifically into the pump-action spray valve, through tube 160.

When the water flow trigger 140 is depressed, water flows through the water outlet 120. As discussed above, this water stream contains no soap.

With the water flow trigger 140 depressed, a soapy foam can be produced by squeezing the soap flow trigger 150 one or more times, causing liquid soap to be drawn from the soap container 170 via the tube 160 and injected into the water stream through the soap dispensing orifice 110.

When the soap flow trigger 150 is not depressed, no liquid soap is injected into the water stream through the soap dispensing orifice 110. Therefore, no soapy foam is produced.

Because the liquid soap is injected into the water stream after the water passes cleanly through the soap dispensing spray nozzle 100, the production of soapy foam can be turned on and off nearly instantaneously.

Figure 2:
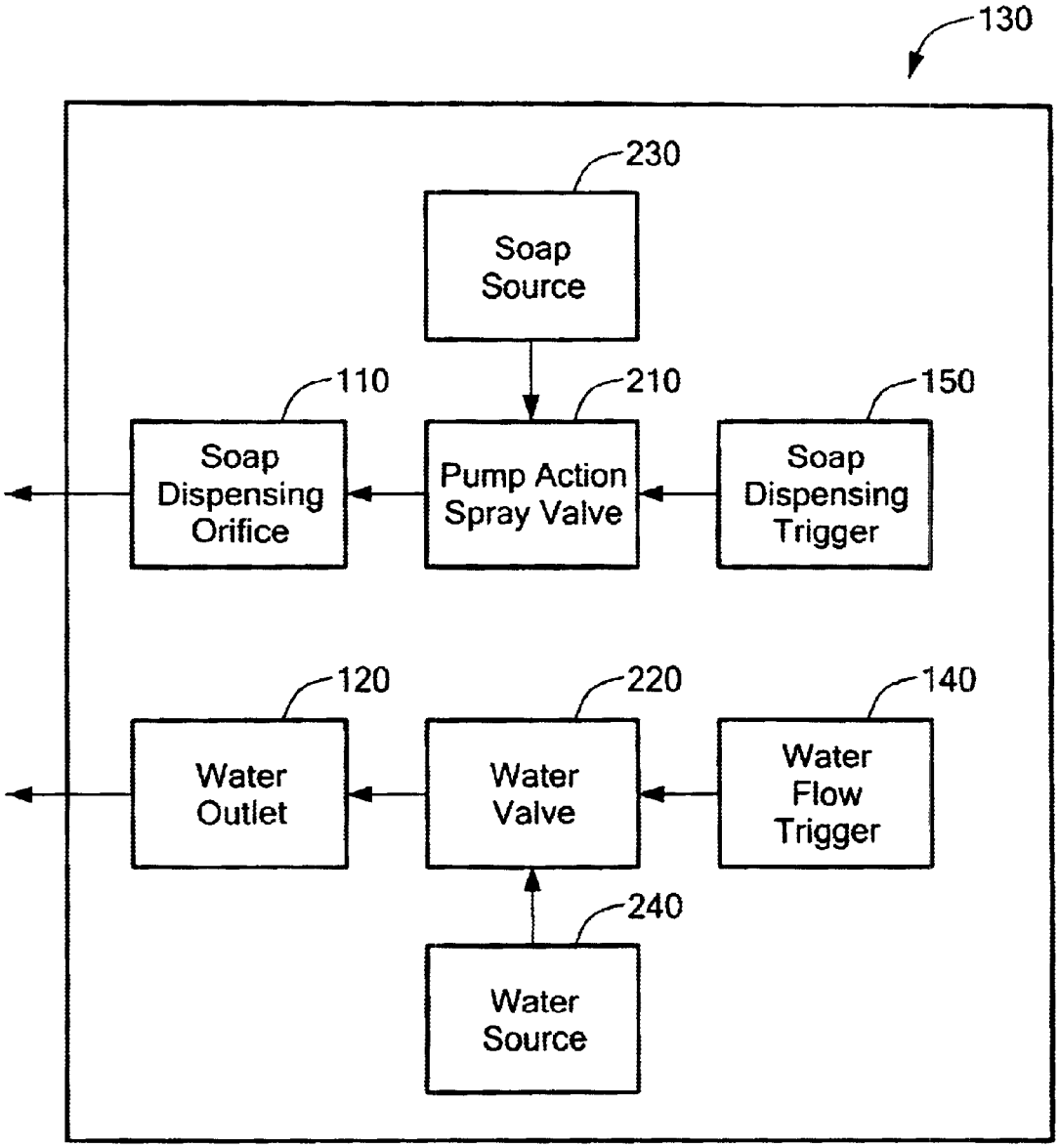
FIG. 2 shows the relevant components of a soap dispensing spray nozzle in accordance with an embodiment of the present invention.

FIG. 2 shows the relevant components of an exemplary soap dispensing spray nozzle having a pump action soap sprayer in accordance with an embodiment of the present invention. Among other things, the soap dispensing spray nozzle includes a body 130 that houses various other components, including a water outlet 120, a water valve 220, a water flow trigger 140, a water source 240, a soap dispensing orifice 110, a pump action spray valve 210, a soap dispensing trigger 150, and a soap source 230. The water source 240 typically includes a connector for connecting the nozzle to the hose 190. The soap source 230 typically includes the tube 160 for drawing soap from an internal or external reservoir. The water flow trigger 140 controls the water valve 220 to selectively pass water from the water source 240 to the water outlet 120 to produce a water stream. The soal dispensing trigger 150 controls the pump action spray valve 210 to selectively pump soap from the soap source 230 to the soap dispensing orifice 110 to inject soap into the water stream.

The present invention may be embodied in other specific forms without departing from the true scope of the invention. The described embodiments are to be considered in all respects only as illustrative and not restrictive.

What is claimed is:

1. A foam producing spray nozzle comprising:

a nozzle body having a first end and a second end, the first end being coupled to a source of water;

a water outlet at the second end of the nozzle body for outputting a water stream;

at least one soap dispensing orifice at the second end of the nozzle body aimed so as to dispense liquid soap into the water stream;

a soap dispensing trigger for causing the liquid soap to be dispensed through the at least one soap dispensing orifice into the water stream; and a pump-action sprayer mounted within the nozzle body and actuated by the soap dispensing trigger for injecting the liquid soap through the at least one soap dispensing orifice into the water stream so as to produce a soapy foam.

2. The foam producing spray nozzle of claim 1, further comprising:

a water valve for selectively starting and stopping the flow of water through the water outlet; and a water flow trigger for controlling the water valve.

3. The foam producing spray nozzle of claim 1, further comprising:

a soap container for holding the liquid soap for injection through the at least one soap dispensing orifice into the water stream by the pump action sprayer.

4. The foam producing spray nozzle of claim 1, wherein the soap dispensing trigger is located on a front side of the foam producing spray nozzle body.

5. The foam producing spray nozzle of claim 2, wherein the water flow trigger is located on a rear side of the foam producing spray nozzle body.

* * * * *